United States Patent [19]

Reid et al.

[11] 4,092,157

[45] May 30, 1978

[54] PROCESS FOR PREPARING SILVER-CADMIUM OXIDE ALLOYS

[75] Inventors: F. Joseph Reid, Acton; Han J. Kim, Chelmsford, both of Mass.

[73] Assignee: GTE Laboratories Incorporated, Waltham, Mass.

[21] Appl. No.: 722,855

[22] Filed: Sep. 10, 1976

[51] Int. Cl.[2] ..... B22F 3/00

[52] U.S. Cl. ..... 75/206; 75/211; 75/221; 200/265; 200/266

[58] Field of Search ..... 75/206, 211, 221; 200/265, 266

[56] References Cited

U.S. PATENT DOCUMENTS

| | | | |
|---|---|---|---|
| 3,019,103 | 1/1962 | Alexander et al. | 75/206 |
| 3,501,287 | 3/1970 | Lever | 75/206 |
| 3,954,459 | 5/1976 | Schreiner et al. | 75/206 |

OTHER PUBLICATIONS

Stevens, "Powder Metallurgy" No. 34, vol. 17, 1974, pp. 331, 40–43.

Goetzel, *Treatise on Powder Metallurgy,* vol. II, 1950, pp. 220–222.

*Primary Examiner*—Brooks H. Hunt

*Attorney, Agent, or Firm*—David M. Keay

[57] ABSTRACT

This application describes the step-wise application of heat during the sintering of a mixture of silver and cadmium oxide to give an alloy having improved characteristics. These alloys are useful as electric contacts in high electric current applications.

13 Claims, No Drawings

PROCESS FOR PREPARING SILVER-CADMIUM OXIDE ALLOYS

BACKGROUND OF THE INVENTION

Sintered silver-cadmium oxide contact members are useful for high electric current applications. Sintered silver-cadmium oxide contact members are formed by blending fine particle size silver and cadmium oxide powders into a uniform mixture. This mixture is pressed into a compact suitable for sintering. The sintering step is conducted by heating the pressed compact to a temperature of about 900° C and holding the material at that temperature for about one hour.

Difficulties experience in attaining densification during the sintering of the two materials are largely attributable to the morphology associated with such sintered materials where pores and cadmium oxide aggregates are present in the silver grain boundaries. Because of the dissociation of cadmium oxide during sintering, the insolubility of cadmium oxide in the silver matrix and the continual growth of cadmium oxide aggregates through an evaporation/condensation mechanism, the maximum density of the silver-cadmium oxide contacts is typically less than theoretical.

During the sintering, the two major processes-the normal diffusional process for silver-silver particle bonding and the opposing force to densification exerted by the cadmium partial pressure are operating simultaneously. Since the temperature dependence of the silver diffusional force is less than that of the cadmium partial pressure, there exists a temperature above which sintering is seriously impeded by the cadmium pressure. Moreover, the cadmium vapor pressure generated in a closed pore during sintering is probably higher than in an open environment due to a decrease in the oxygen partial pressure through diffusion of oxygen into silver grains.

The resultant difficulties in attaining good densification of the two materials create the excessive growth of cadmium oxide aggregates in the sintered body which in turn accompanies inferior arc erosion resistance which is an important attribute of a good electrical contact.

OBJECTS OF THE INVENTION

The present invention provides an improved process for preparing silver-cadmium oxide alloys which are in turn useful in forming electric contact members.

The present invention further provides novel silver-cadium oxide alloys having improved aggregate-pore assemblies.

These and further objects, features and advantages of the present invention will be apparent from the following more detailed description.

SUMMARY OF THE INVENTION

The present invention is achieved by the utilization of a novel step-wise application of heat during the sintering process. It has been found that by utilizing a pretreatment at a lower temperature, prior to the usual ca. 900° C sintering sequence, optimum sintering is achieved thereby providing, fine cadmium oxide distribution with minimum aggregate formation. The variation of properties in the sintered material, obtained by the altered sintering schedule of this invention, is believed due to the dynamic balancing of the two opposing forces (discussed above) with respect to the degree of pore removal.

In general, the pretreatment of the present invention can be employed using otherwise usual, known conditions common to sintering such materials. The lower temperature, on the order of from about 750° C to about 850° C, preferably in the order of about 790° C to about 810° C provide the desired effect.

DETAILED DESCRIPTION OF INVENTION

The pretreatment can be conducted at the indicated, reduced temperature for a period of time ranging generally from about 0.5 to about 2 hours, preferably on the order of one hour or so.

The silver-cadmium oxide blend will generally contain about 10 to 15% cadmium oxide and about 90 to 80% silver, although blends having about 5 to 30% cadmium oxide and about 95 to 70% silver, respectively, can also be employed. They normally contain no additives.

The sintering step itself is conducted at a temperature elevated above those employed herein for the pretreatment. The common sintering procedure practiced in the trade is to heat the compact of silver-cadmium oxide mixture pressed at about 560 $Kg/cm^2$ to about 5600 $Kg/cm^2$ from ambient temperature to about 900° C at a rate of about 10° to 40° per minute in air using, e.g, a muffle furnace for batch process or a belt furnace for continuous process. The novel lower temperature pretreatment hereof may otherwise employ these same general conditions. Preferably, the silver-cadmium oxide blend prepared for sintering is heated first at from about 750° C to about 850° C for about 30 to about 120 minutes followed by treatment at the usual sintering temperature of about 900° C for from about one to about two hours, preferably about one hour or so.

It has been found that the alteration of the heating schedule during sintering such that the compact is heated within the about 750° to about 850° C range prior to the final sinering temperature provides a product having the optimum size distribution of cadmium oxide particles; the largest particle size was associated with a pretreatment temperature of about 750° C. About 800° C appears to be the critical temperatur at which the largest silver-silver bonding diffusional force is generated before an interfering effect of cadmium oxide vapor and an appreciable cadmium oxide particle growth dominate the sintering process.

Between about 750° C and about 800° C, most of the pores become closed, the pore size increasing with decreasing pretreatment temperature. The larger cadmium oxide particle size distribution observed in a sample pretreated at about 750° C is apparently due to the growth of cadmium oxide particles existing in the large closed pores, upon subsequent higher temperature heating.

Below about 750° C, the pretreatment does not completely close all the pores, leading to a microstructure similar to one developed without altering the heating schedule.

The novel product prepared by the novel heating schedule hereof is characterized by having a more uniform particle size distribution and a substantial cadmium oxide particle refinement. It was determined from quantitative metallographic examination that approximately a 40% increase in the number of less than one micrometer size particles and a corresponding decrease in large aggregates were effected by the novel sintering schedule hereof. Thus, the novel compacts hereof have a uniform distribution of cadmium oxide particles with from about 75% to about 90% of said particles having a size of less than or equal to about 1 micrometer.

DESCRIPTION OF SPECIFIC EMBODIMENTS

The following examples serve to further illustrate the present invention and set forth the preferred embodiments for the practice thereof. As such, however, they are not to be considered as limitations upon the overall scope hereof.

The following example describes the preparation of a silver-cadmium oxide compact, sintered under conventional sintering techniques.

EXAMPLE A

Three (3) grams of a well-blended mixture containing 85% silver particles and 15% cadmium oxide particles is pressed using a pressure of 560 Kg/cm$^2$ to obtain a compact 0.2 cm in thickness and having approximately 50% porosity, with particle sizes on the order of one micrometer.

The resultant compact is heated to 890° C at about 28° c/min and held at this temperature for 60 minutes.

The resultant contact exhibited about 21% shrinkage, about 9.40 g/cm$^3$ density, and 46 (Knoop scale with 50 g load) hardness. The resultant contact also exhibited approximately $4.3 \times 10^{10}$ cadmium oxide particles of less than one micrometer size, and approximately $1.3 \times 10^{10}$ cadmium oxide particles of equal to or greater than one micrometer size, contained in one cm$^3$ volume of the contact.

The following examples describe the process of the present invention.

EXAMPLE I

Three (3) grams of a mixture containing 85% silver particles and 15% cadmium oxide particles is pressed using a pressure of 560 kg./cm.$^2$ to obtain a compact 0.2 cm. in thickness and having approximately 50% porosity, with particle sizes on the order of 1 micrometer.

The resultant compact is heated to 790° C at about 28° C/min. and held at this temperature for 60 minutes. Thereafter, the compact is heated to 890° C at about 28° C/min. and held at this temperature for an additional 60 minutes.

The resultant contact exhibited a shrinkage of about 21%, about 9.43 g./cm$^3$ density, and 52 (Knoop scale with 50 g. load) hardness. The resultant contact also exhibited approximately $6.6 \times 10^{10}$ cadmium oxide particles of less than one micrometer size, and approximately $1.2 \times 10^{10}$ cadmium oxide particles of equal to or greater than one micrometer size, contained in one cm$^3$ volume of the contact.

EXAMPLE II

The procedure of Example I was repeated using a pretreatment temperature of 750° C for 2 hours to give a product having a density of 9.38 g/cm.$^3$.

EXAMPLE III

Three (3) grams of a well-blended mixure containing 85% silver particles and 15% cadmium oxide particles is pressed using a pressure of 560 Kg/cm$^2$ to obtain a compact 0.2 cm in thickness and having approximately 50% porosity, with particle sizes on the order of one micrometer.

The resultant compact is heated to 824° C at about 28° C/min. and held at this temperature for 60 minutes. Thereafter, the compact is heated to 890° C at about 28° C/min and held at this temperature for an additional 60 minutes.

The resultant contact exhibited about 21% shrinkage, about 9.41 g/cm$^3$ density, and 56 (Knoop scale with 50g load) hardness. The resultant contact also exhibited an approximately 40% increase in the number of less than one micrometer size cadmium oxide particles and a corresponding decrease in large cadmium oxide aggregates compared to the conventionally sintered material.

EXAMPLE IV-VII

Compacts are prepared according to the procedures of Example III, as modified according to the conditions, as set forth below in Table I, and with the results as set forth below in Table II:

Table I

| Example | Pretreatment Temperature, ° C, and time Thereat |
|---|---|
| IV | 765, 1 hr. |
| V | 759, 1 hr. |
| VI | 800, 2 hr. |
| VII | 830, 2 hr. |

Table II

| Example | Density, g./cm$^3$ | Hardness, Knoop scale with 50 g. load |
|---|---|---|
| IV | 9.40 | 59 |
| V | 9.39 | — |
| VI | 9.39 | — |
| VII | 9.37 | — |

We claim:

1. The process for preparing a silver-cadmium oxide alloy which comprises heating a compact of silver-cadmium oxide at from about 750° C to about 850° C, and thereafter heating at an elevated temperature of about 900° C.

2. The process of claim 1 wherein said compact is additive free.

3. The process of claim 2 wherein said first-mentioned heating is conducted for from about 30 to about 120 minutes.

4. The process of claim 3 wherein said first-mentioned heating is conducted at from about 790° C to about 810° C.

5. The process of claim 4 wherein said first-mentioned heating is conducted for about 60 minutes.

6. The process of claim 2 wherein said compact contains about 70% to about 95% silver particles and about 30% to about 5% cadmium oxide particles.

7. The process of claim 2 wherein said compact contains about 85% silver particles and about 15% cadmium oxide particles.

8. A process for preparing a silver-cadmium oxide alloy which comprises forming a compact of silver particles and cadmium oxide particles, heating said compact at from about 750° C to about 850° C, and thereafter further heating said heated compact at an elevated temperature of about 900° C.

9. The process of claim 8 wherein said compact is additive free and is formed by providing a blend of silver particles and cadmium oxide particles and compacting said blend with pressure.

10. The process of claim 9 wherein said first-mentioned heating is conducted for from about 30 to about 120 minutes.

11. The process of claim 9 wherein said first-mentioned heating is conducted at about 790° C to about 810° C.

12. The process of claim 11 wherein said first-mentioned heating is conducted for about 60 minutes.

13. The process of claim 9 wherein said compact contains about 85% silver particles and about 15% cadmium oxide particles.

* * * * *